US007497556B2

(12) United States Patent
Onozawa

(10) Patent No.: US 7,497,556 B2
(45) Date of Patent: Mar. 3, 2009

(54) MIST SPRAYING APPARATUS AND IMAGE FORMING APPARATUS

(75) Inventor: Sho Onozawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 412 days.

(21) Appl. No.: 11/376,157

(22) Filed: Mar. 16, 2006

(65) Prior Publication Data

US 2006/0209130 A1 Sep. 21, 2006

(30) Foreign Application Priority Data

Mar. 18, 2005 (JP) ..... 2005-080169

(51) Int. Cl.
*B41J 2/06* (2006.01)

(52) U.S. Cl. ..... 347/55; 347/54

(58) Field of Classification Search ..... 347/54–55, 347/68, 70–71

See application file for complete search history.

(56) References Cited

U.S. PATENT DOCUMENTS 6,244,690 B1 * 6/2001 Kwon et al. ..... 347/54

FOREIGN PATENT DOCUMENTS

JP 5-57891 A 3/1993

OTHER PUBLICATIONS

Kameyama et al., Journal of the Acoustical Society of Japan, 2004, pp. 53-60, vol. 60, No. 2.

"Dynamic Properties of the Surface Tension of Water and Aqueous Solutions of Surface Active Agents with Standing Capillary Waves in the Frequency Range from 10 kc/s to 1.5 Mc/s," W. Eisenmenger, Acustica, vol. 9 (1959), pp. 327-340.

* cited by examiner

*Primary Examiner*—Juanita D Stephens
(74) *Attorney, Agent, or Firm*—Birch, Stewart, Kolasch & Birch, LLP

(57) ABSTRACT

The mist spraying apparatus comprises: a liquid chamber into which liquid is filled; a coil which is applied with an electrical signal to generate a magnetic filed, the electrical signal having a frequency corresponding to an ultrasonic wave; a diaphragm which is vibrated by the magnetic field generated by the coil, and imparts the ultrasonic wave to the liquid in the liquid chamber; a spraying port which is connected to the liquid chamber and sprays the liquid converted into a mist by the ultrasonic wave; and a drive unit which applies the electrical signal to the coil.

12 Claims, 12 Drawing Sheets

SIMPLIFIED STRUCTURE

EQUIVALENT CIRCUIT

MIST SPRAYING APPARATUS AND IMAGE FORMING APPARATUS

BACKGROUND OF THE INVENTION

1. Field of the Invention

The present invention relates to a mist spraying apparatus and image forming apparatus, and more particularly, to a mist spraying apparatus which sprays a liquid in the form of a mist, and an image forming apparatus which forms images on a recording medium, such as a paper, by means of a mist spray.

2. Description of the Related Art

An ink mist type of image forming apparatus which forms images by generating an ink mist (very fine ink particles) by means of ultrasonic vibration, and depositing this ink mist onto a recording medium, such as paper (see, for example, Japanese Patent Application Publication No. 5-57891 (and in particular, FIG. 3) and "Study on Ink Ejection of Print Head Using Focused Ultrasonic Wave and Nozzle" (Shumpei Kameyama, Hiroshi Fukumoto, and Shusou Wadaka, Journal of the Acoustical Society of Japan, Vol. 60, No. 2, (2004), pp. 53-60)).

Generally, a piezoelectric body is used as a device for generating ultrasonic vibration. For example, a piezoelectric body made of lead zirconate titanate (PZT) which has been polarized previously in the thickness direction is used, and a voltage having a frequency corresponding to an ultrasonic wave (for example, 10 MHz) is applied in the thickness direction of the piezoelectric body. By utilizing the displacement (distortion) generated in the thickness direction of the piezoelectric body, when a diaphragm is caused to vibrate and an ultrasonic wave is applied to the ink inside an ink chamber, the meniscus at the nozzle connected to the ink chamber becomes unstable, and ink in the form of a mist is sprayed from the nozzle.

However, in an ink mist type image forming apparatus using a conventional piezoelectric body, it is difficult to achieve a mist spray of ink having a high viscosity (for example, approximately 20 cP).

For example, the amplitude of movement of a diaphragm in the d33 mode (where the polarization direction, electric field direction and direction of distortion are all the same) in the case of a piezoelectric body having a thickness of several tens micrometers (μm) to several hundred micrometers, is approximately ten nanometers (nm) when driven at several tens volts (V). Even if the piezoelectric body has a laminated structure, the amplitude of the piezoelectric body is currently limited to the sub-micron order.

On the other hand, when spraying ink in the form of a mist, the amplitude required in order to destabilize the meniscus surface is directly proportional to the viscosity of the ink that is to be sprayed. For example, the meniscus of ink having a viscosity of several centipoises (cP) can be broken down at an amplitude of the order of several hundred nanometers, but the meniscus of ink having a viscosity of several tens centipoises cannot be broken down unless the amplitude reaches several micrometers.

It is possible to multiply the amplitude by several times, by attaching horns of various shapes. However, even if the amplitude is increased in this way, in a conventional image forming apparatus which uses piezoelectric bodies made of PZT, or the like, it is not possible to break down the meniscus of ink having a viscosity of around 20 cP, and therefore, ink of this viscosity cannot be sprayed in the form of a mist. For example, with a single-plate piezoelectric body, it is not possible to achieve meniscus break-down in ink having a viscosity of 10 cP.

SUMMARY OF THE INVENTION

The present invention has been contrived in view of the aforementioned circumstances, an object thereof being to provide a mist spraying apparatus and image forming apparatus capable of spraying even a high-viscosity liquid in the form of a mist.

In order to attain the aforementioned object, the present invention is directed to a mist spraying apparatus, comprising: a liquid chamber into which liquid is filled; a coil which is applied with an electrical signal to generate a magnetic filed, the electrical signal having a frequency corresponding to an ultrasonic wave; a diaphragm which is vibrated by the magnetic field generated by the coil, and imparts the ultrasonic wave to the liquid in the liquid chamber; a spraying port which is connected to the liquid chamber and sprays the liquid converted into a mist by the ultrasonic wave; and a drive unit which applies the electrical signal to the coil.

By means of this composition, the diaphragm is made to vibrate ultrasonically due to magnetic force by applying an electrical signal having a frequency corresponding to an ultrasonic wave to the coil, and hence a large amplitude is obtained in comparison with a case where the diaphragm is made to vibrate ultrasonically by means of a conventional piezoelectric body. Therefore, even high-viscosity liquids can be converted into a mist and sprayed.

Preferably, the mist spraying apparatus further comprises: a first magnetic body which is disposed inside the coil; a second magnetic body which is arranged on the diaphragm in a separated position from the first magnetic body, wherein the diaphragm vibrates due to a magnetic force between the first magnetic body and the second magnetic body, when the first magnetic body is magnetized by flow of current of the electrical signal in the coil.

Apart from a mode of this kind, other possible compositions include one where the diaphragm itself is formed by a magnetic body which is disposed on the inner side of the coil, and the magnetic body inside the coil becomes magnetized when an electric signal of an ultrasonic frequency is applied to the coil, thereby generating a magnetic force between the magnetic body and the diaphragm (magnetic body), which causes the diaphragm to vibrate ultrasonically, or a composition (dynamic system) in which a coil is provided on the diaphragm itself, and the diaphragm is directly made to vibrate ultrasonically, when an electrical signal of a frequency corresponding to an ultrasonic wave is applied to the coil.

The frequency corresponding to an ultrasonic wave is preferably 2 MHz or above, which is a frequency at which the liquid is converted into a mist. This frequency may vary with the type of liquid, and the structure of the spraying ports and liquid. It is also possible to set the actual frequency by experimentation. For example, an electrical signal of 10 MHz is applied to the coil, thereby causing the diaphragm to vibrate ultrasonically and generating a capillary wave in the liquid surface (meniscus) at the spraying port, whereby a cluster of micro-particles of ink are sprayed from the liquid surface at the spraying port.

Preferably, the liquid chamber has a parabolic inner surface shape which reflects the ultrasonic wave applied to the liquid in the liquid chamber by the diaphragm, and focuses the ultrasonic wave at the spraying port.

By means of this composition, the ultrasonic wave applied to the liquid inside the liquid chamber by the diaphragm is focused at the spraying port by the parabolic shaped inner surface, and therefore, the liquid can be converted efficiently into a mist at the spraying port.

Preferably, the diaphragm is made of duralumin.

Duralumin is an alloy having aluminum as a main component, which can be obtained by dispersing a very fine precipitate by age hardening. The main composition is 95 wt % aluminum, 4 wt % copper, 0.5 wt % magnesium, and 0.5 wt % manganese. It is also possible to vary the combination ratio of the compositional elements suitably, or to use duralumin having other additional components.

By means of this composition, since the main component of the diaphragm is aluminum, which has a sufficient low Young's modulus, then a large amplitude can be obtained, and furthermore, since the diaphragm has a suitable restorative force, stable ultrasonic vibration can be achieved.

In order to attain the aforementioned object, the present invention is also directed to an image forming apparatus, comprising the above-described mist spraying apparatus, which forms an image on a prescribed liquid receiving medium by means of the liquid sprayed from the spraying port.

By means of this composition, it is possible to spray even an ink of high viscosity onto an ink receiving medium, in the form of a mist, and therefore, a high-quality image can be formed.

According to the present invention, it is possible to spray even liquids of high viscosity in the form of a mist.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 7 is a graph showing the relationship between the gap $l_g$ between the magnetic bodies, and the amount of displacement of the diaphragm, $\Delta Z$, and the like;

DETAILED DESCRIPTION OF THE PREFERRED EMBODIMENTS

Basic Composition of Mist Spraying Apparatus

Figure 1:
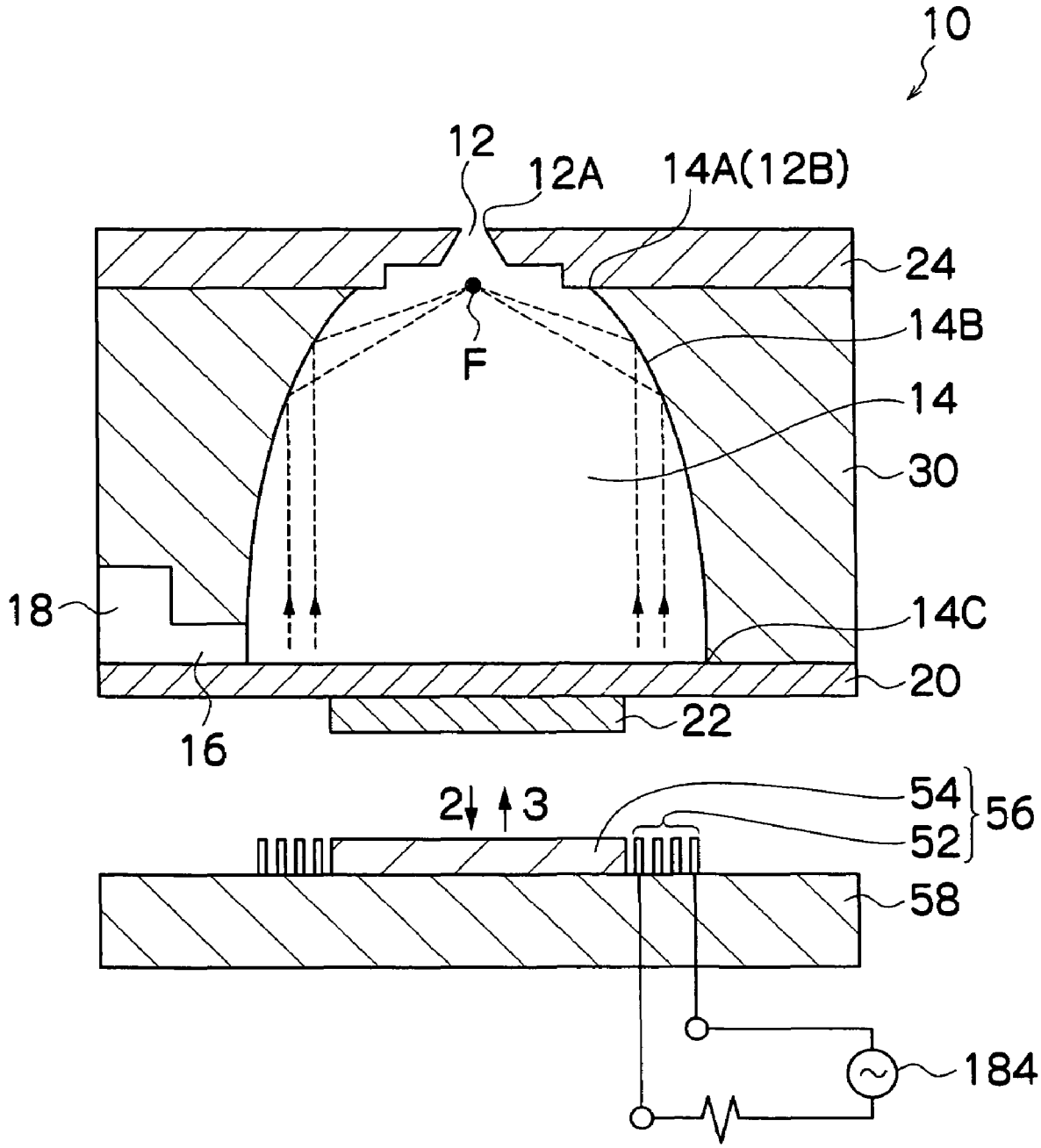
FIG. 1 is a cross-sectional diagram showing the basic composition of a mist spraying apparatus according to an embodiment of the present invention.

FIG. 1 is a cross-sectional diagram showing the basic composition of a mist spraying apparatus according to an embodiment of the present invention.

The mist spraying apparatus 10 shown in FIG. 1 comprises: a nozzle 12 forming an opening from which ink is sprayed; an ink chamber 14 connected to the nozzle 12; an ink supply port 16 forming an opening through which ink is supplied to the ink chamber 14; a common flow channel 18 through which ink to be supplied to the ink chamber 14 through the ink supply port 16 flows; a diaphragm 20 disposed on the opposite side of the ink chamber 14 from the side where the nozzle 12 is located; a magnetic body 22 bonded to the surface of the diaphragm 20 reverse to the surface thereof adjacent to the ink chamber 14; an electromagnet 56 comprising a coil 52 and a core 54, disposed in a position separated from the magnetic body 22 on the diaphragm 20; and a substrate 58 which holds the electromagnet 56.

FIG. 1 shows a cross-sectional view of one ink chamber unit corresponding to one nozzle 12 (a single mist spraying element), but in the case of a print head (also called a "recording head") for forming images on a recording medium by moving relatively with respect to the recording medium, such as paper, a structure comprising a one-dimensional (row-shaped) or two-dimensional (plane-shaped) arrangement of a plurality of ink chamber units is adopted. In a print head of this kind, in practice, a plurality of nozzles 12 are formed in a nozzle forming plate 24, a plurality of ink chambers 14 are formed in an ink chamber forming plate 30, a plurality of magnetic bodies 22 are provided corresponding to these ink chambers 14, and a plurality of electromagnets 56 are held on the substrate 58.

Figure 2:
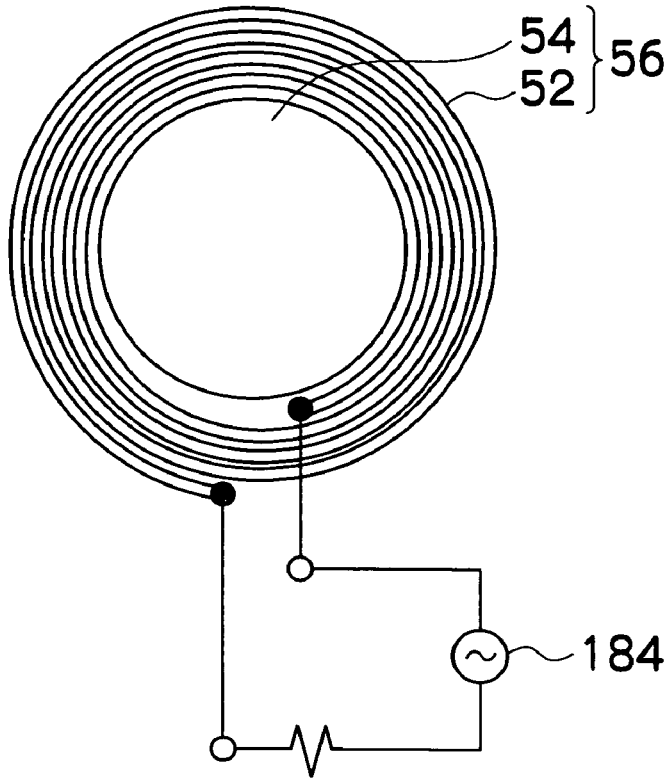
FIG. 2 is a plan diagram viewed in the direction of arrow 2 in FIG. 1.

FIG. 2 shows a plan diagram of the electromagnet 56 as viewed in the direction of the arrow 2 in FIG. 1.

The core 54 of the electromagnet 56 is made of a magnetic body. The coil 52 made of a conductive material is wound at least once about the core 54, at an interval from the core 54. The coil 52 shown in FIGS. 1 and 2 is wound approximately four times, but the number of turns of the coil 52 is not limited in particular to the number of turns illustrated.

When no current is flowing in the coil 52, the electromagnet 56 does not produce any magnetic field, and hence no magnetic force is generated between the core 54 of the electromagnet 56 and the magnetic body 22 on the diaphragm 20. When current is flowing in the coil 52, then a magnetic field is produced by the electromagnet 56 and a magnetic force is generated between the core 54 of the electromagnet 56 and the magnetic body 22 on the diaphragm 20.

A head driver 184 generates an electrical signal of a frequency corresponding to an ultrasonic wave (for example, 10 MHz), and applies this signal to the coil 52 of the electromagnet 56.

When the electrical signal of the ultrasonic frequency is applied to the coil 52 of the electromagnet 56, the core 54 of the electromagnet 56 repeatedly alternates between a state of attracting and repelling the magnetic body 22 on the diaphragm 20, and an ultrasonic vibration is thereby applied to the diaphragm 20.

Figure 3:
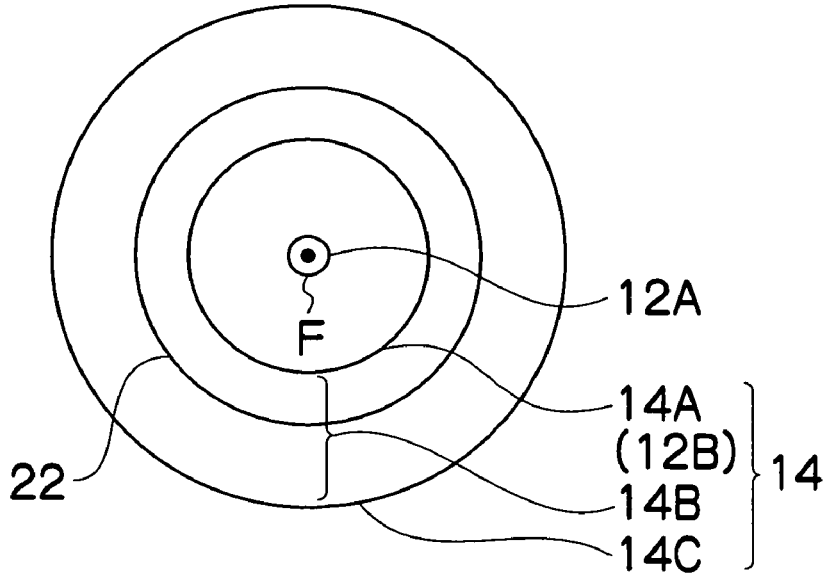
FIG. 3 is a plan view perspective diagram viewed in the direction of arrow 3 in FIG. 1.

FIG. 3 shows a plan perspective diagram of the ink chamber 14 and the magnetic body 22 as viewed in the direction of the arrow 3 in FIG. 1.

The magnetic body 22 bonded to the diaphragm 20 is attracted or repelled by the core 54 of the diaphragm 56, in accordance with the electrical signal supplied to the coil 52 of the electromagnet 56. More specifically, the magnetic force between the core 54 of the diaphragm 56 and the magnetic body 22 on the diaphragm 20 changes in accordance with the electrical signal of the ultrasonic frequency which flows in the coil 52 of the electromagnet 56, and hence the magnetic body 22 repeatedly alternates between a state of attraction and repulsion to and from the electromagnet 56, at the ultrasonic frequency. Consequently, the diaphragm 20 vibrates ultrasonically, and an ultrasonic wave is thus imparted from the diaphragm 20 to the ink inside the ink chamber 14.

The ink chamber 14 has a parabolic internal surface 14B which reflects the ultrasonic wave applied to the ink in the ink chamber 14 from the diaphragm 20, and focuses the ultrasonic wave at the nozzle 12. The ink chamber forming plate 30 and the nozzle forming plate 24 are bonded in such a manner that the center of the opening 12B of the nozzle 12 on the side by the ink chamber 14 is located at the focal point F of the parabolic surface 14B. The parabolic surface 14B of the ink chamber 14 forms a reflecting plate (also called a "reflector") which reflects the ultrasonic wave, and from the viewpoint of high reflectivity, a metallic material is preferably used for the ink chamber forming plate 30.

The magnetic body 22 shown in the embodiment in FIGS. 1 and 3 has a larger surface area than the downstream side opening 14A of the parabolic surface 14B (the edge of the opening which is in contact with the nozzle forming plate 24), and the magnetic body 22 has a smaller surface area than the upstream side opening 14C of the parabolic surface 14B (the edge of the opening which is in contact with the diaphragm 20). The planar shape of the magnetic body 22 is not limited in particular to being a circular shape of this kind, and various other modes are possible, such as a quadrilateral shape, typically, a square shape, or another polygonal shape, an elliptical shape, or the like.

Ink introduced from the common flow channel 18 through the ink supply port 16 is filled into the ink chamber 14 surrounded by the parabolic surface 14B, the diaphragm 20 and the nozzle forming plate 24.

The diaphragm 20 is disposed on the surface of the ink chamber forming plate 30 reverse to the surface thereof adjacent to the nozzle forming plate 24, and is bonded to the ink chamber forming plate 30 in a composition which seals off the face of one portion of the ink chamber 14.

In specific terms, the diaphragm 20 is made of duralumin. Duralumin is an alloy having aluminum as a main component, which can be obtained by dispersing a very fine precipitate by age hardening. The main composition is 95 wt % aluminum, 4 wt % copper, 0.5 wt % magnesium, and 0.5 wt % manganese. It is also possible to vary the combination ratio of the compositional elements suitably, or to use duralumin having other additional components.

The diaphragm 20 vibrates together with the magnetic body 22, due to its flexibility, and hence an ultrasonic wave radiates in the ink inside the ink chamber 14 through the diaphragm 20.

The ultrasonic wave radiated through the ink from the piezoelectric element 20 propagates through the ink chamber 14, through the medium of the ink, and converges in the vicinity of the focal point F (in the vicinity of the central region of the cross-section of the opening of the nozzle 12), due to reflection at the parabolic surface 14B. FIG. 1 shows a schematic diagram in which the directions of travel of the wave fronts of the pressure waves having the ultrasonic frequency are indicated by broken lines. Due to the energy of the focused ultrasonic wave, a capillary wave intrinsic to the frequency is generated in the liquid surface (meniscus) in the nozzle 12, and fine droplets of ink become separated from the wave peaks in the minute surface wave thus created. Consequently, a collection of fine particles in the form of a mist (a mist cluster) is sprayed from the nozzle 12.

The electromagnet 56 and the magnetic body 22 form a magnetic actuator which is a vibration generating device for causing the diaphragm 20 to vibrate.

Mist Formation Conditions

Figure 4:
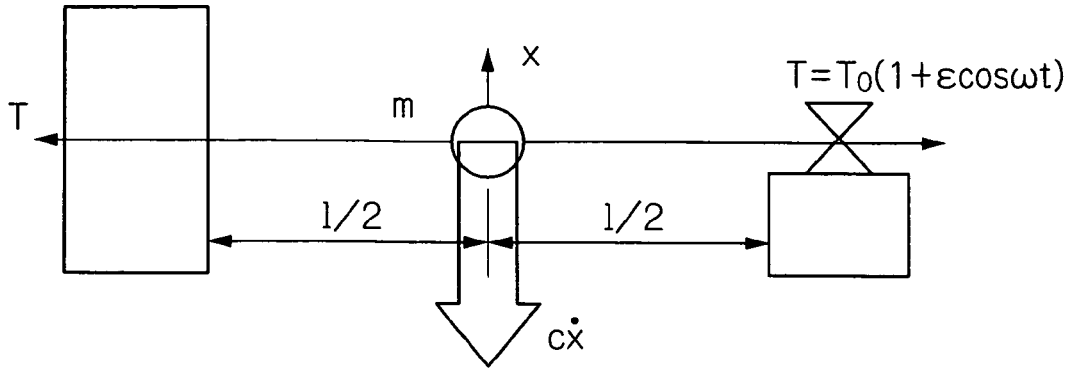
FIG. 4 is a schematic drawing showing a model used to explain mist creation conditions.

The conditions for spraying a liquid in the form of a mist from the nozzle 12 by destabilizing the meniscus at the nozzle 12 (the mist formation conditions) are described with respect to the model shown in FIG. 4.

The model shown in FIG. 4 is composed by applying a particle m on the center of a string of length l subject to a periodic change in tension of $T=T_0(1+\epsilon \cos \omega t)$ and a viscous damping force of c dx/dt.

In this model, the equation of motion for the particle is written as:

$$\ddot{x} + \frac{c}{m}\dot{x} + \frac{4T_0}{ml}(1 + \varepsilon\cos\omega t)x = 0. \tag{1}$$

The following substitutions are made with respect to the equation of motion (1): c/m to $4\mu k^2/\rho$, $4T_0/ml$ to $k^3T/\rho$, and $\epsilon$ to $hk(\omega/\omega_0)^2$; and thereby an equation of motion relating to meniscus vibration (one-dimensional vibration at a particular point) is obtained (Lamb, H., Hydrodynamics, Macmillan, London 1931, p. 708). The oscillation conditions of these parameters are expressed as:

$$h \geq 2\frac{\mu}{\rho}\left(\frac{\rho}{T\pi f}\right)^{\frac{1}{3}}, \tag{2}$$

where h is the onset amplitude of the meniscus surface, f is the frequency of the ultrasonic wave, ρ is the density of the liquid, T is the surface tension of the liquid, and μ is the viscosity of the liquid (Eisenmenger, W., "Dynamic properties of the surface tension of water and aqueous solutions of surface active agents with standing capillary waves in the frequency range from 10 kc/s to 1.5 Mc/s", Acustica (9) (1959), pp. 327-340).

Accordingly, when f=10 MHz, for a liquid having the density of $\rho=1000\ kg/m^3$, the surface tension of T=30 mN/m, and the viscosity μ=20 cP, then it can be seen that the onset amplitude of h=4.08 μm is required.

Magnetic Actuator

The magnetic actuator constituted by the electromagnet 56 having the coil 52 and the core 54 (the first magnetic body), and the magnetic body 22 (the second magnetic body) on the diaphragm 20, as shown in FIG. 1, is described.

If the magnetic permeability is a constant, then the magnetic energy u ($J/m^3$) per unit volume of the magnetic body is calculated as:

$$u = \frac{1}{2}H \cdot B = \frac{1}{2}\mu H^2 = \frac{B^2}{2\mu}, \tag{3}$$

where H is the magnetic field strength, B is the magnetic flux density, and μ is the magnetic permeability.

When the magnetic body moves through a distance of dl against the magnetic force F. then if the system is isolated, the work is accumulated in the form of the magnetic energy ΔU. Since ΔU=F·dl, then the magnetic force F(N) in the l direction is given by:

$$F = -\frac{\partial U}{\partial l}. \tag{4}$$

If a gap is opened between magnets (having the cross sectional area A) that are uniformly magnetized by the magnetization intensity M, and the magnetic flux density in the gap is B, then since the energy density in the gap is given by the magnetic energy u described above, the magnetic energy ΔU stored when the gap is widened by Δx is calculated as:

$$\Delta U = \frac{1}{2} HB \cdot A\Delta x = \frac{1}{2}\frac{AB^2\Delta x}{\mu_0}, \tag{5}$$

where $\mu_0$ is the magnetic permeability of vacuum.

Therefore, the force F acting in the gap is given by $$F = -\frac{\Delta U}{\Delta x} = -\frac{1}{2}\frac{B^2}{\mu_0}A = -\frac{1}{2}\frac{\Phi^2}{\mu_0 A}, \text{ for } \Phi = AB. \tag{6}$$

Figure 5A:
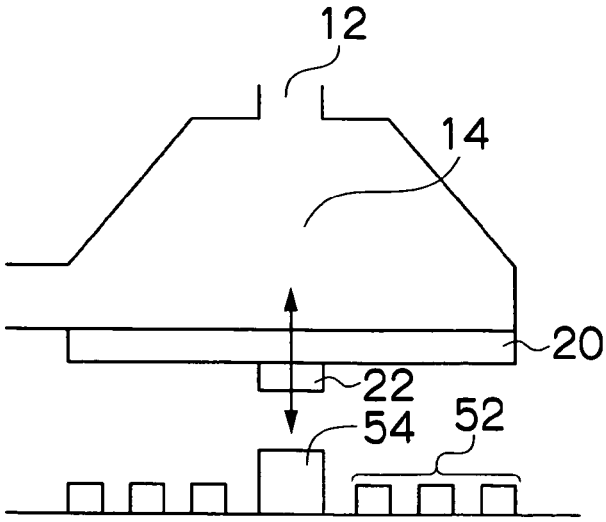
FIG. 5A is a schematic drawing showing the structure of the mist spraying apparatus.
Figure 5B:
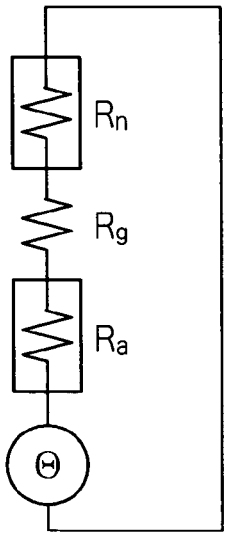
FIG. 5B is a circuit diagram showing an equivalent circuit of the mist spraying apparatus.

With respect to the system of the mist spraying apparatus 10 schematically shown in FIG. 5A, the magnetic equivalent circuit shown in FIG. 5B is considered.

In FIG. 5B, $R_g$ is the magnetic reluctance in the gap between the core 54 of the electromagnet 56 and the magnetic body 22 on the diaphragm 20, $R_a$ is the magnetic reluctance of the core 54, and $R_n$ is the magnetic reluctance of the magnetic body 22 on the diaphragm 20 (in other words, the magnetic body on the side of the nozzle 12).

The magnetomotive force Θ, the magnetic flux Φ and the magnetic reluctance $R_i$ are respectively: Θ(A)=NI, where N is the number of turns of the coil 52, and I is the current flowing in the coil 52; Φ(Wb)=Θ/R; and $R_i(A/Wb)=l_i/(\mu_i A_i)$. The magnetic flux density γ in the gap is given by $\gamma(T)=\Phi/A_g$, where $A_g$ is the cross sectional area of the gap.

Hence, the magnetic force F(N) generated in the gap is given by:

$$F = \frac{(NI)^2}{2\mu_g A_g R^2} = \frac{(NI)^2}{2\mu_g A_g\left(\frac{l_a}{\mu_a A_a} + \frac{l_g}{\mu_g A_g} + \frac{l_n}{\mu_n A_n}\right)^2}, \tag{7}$$

where $\mu_g$ is the permeability of the gap between the core 54 of the electromagnet 56 and the magnetic body 22 on the diaphragm 20, $\mu_a$ is the permeability of the core 54, and $\mu_n$ is the permeability of the magnetic body 22; $A_a$ is the cross sectional area of the core 54, and $A_n$ is the cross sectional area of the magnetic body 22; and $l_g$ is the gap length between the core 54 and the magnetic body 22, $l_a$ is the height of the core 54 of the electromagnet 56, and $l_n$ is the height of the magnetic body 22.

Figure 6:
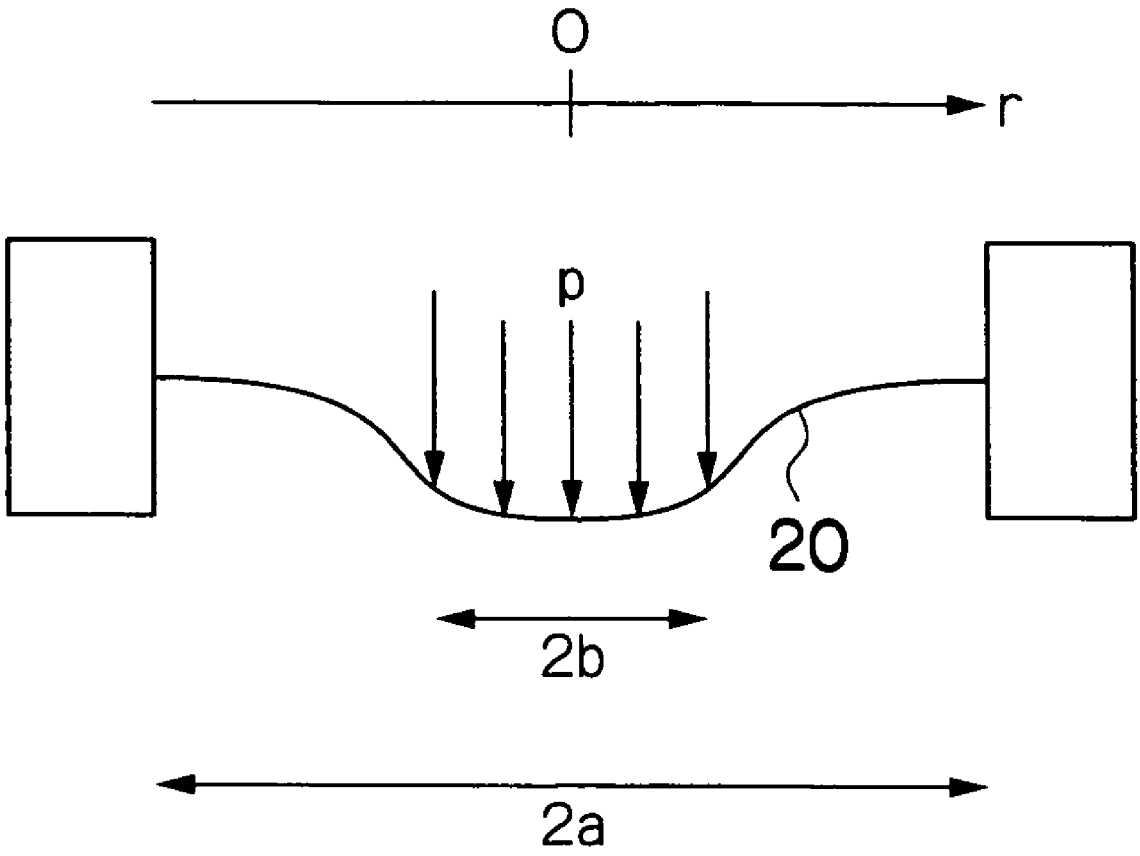
FIG. 6 is a schematic diagram showing the a diaphragm in a vibrating state.

A case is considered where the diaphragm 20 is constituted by a circular disk of radius a, whose edge is fixed, and a uniform load (pressure) p acts within a circle of radius b concentric with the circular disk, as shown in FIG. 6.

The deflected shape w(r) of the diaphragm 20, which has the Young's modulus E, the Poisson ratio ν and the thickness h, is expressed as:

$$0 \le r \le b: w_1 = \frac{pb^4}{16D}\left\{\frac{r^4}{4b^4} - \frac{r^2}{2a^4} + \frac{a^4}{b^2} - \left(1 + \frac{2r^2}{b^2}\right)\ln\frac{a}{b} - \frac{3}{4}\right\}; \tag{8}$$

$$b \le r \le a: w_2 = \frac{pb^4}{16D}\left\{\left(1 - \frac{r^2}{a^2}\right)\frac{a^2}{b^2} - \frac{r^2}{2a^2} - \left(1 + \frac{2r^2}{b^2}\right)\ln\frac{a}{r} + \frac{1}{2}\right\},$$

$$\text{where } D = \frac{Eh^3}{12(1-\nu^2)}.$$

The removed volume ΔV is obtained by double integration in polar coordinates with respect to the deflected shape w(r) expressed above, that is:

$$\Delta V = \int_0^b \int_0^{2\pi} r \cdot w_1(r)\,dr\,d\theta + \int_b^a \int_0^{2\pi} r \cdot w_2(r)\,dr\,d\theta. \tag{9}$$

The actual value of the removed volume ΔV can be found by numerical integration.

Furthermore, the generated pressure p is calculated as $p=F/A_n$.

Here, it is assumed that a=200 μm and b=70 μm, and that the diaphragm 20 is made of a material having a relatively low Young's modulus, for example, duralumin having the Young's modulus of E=71.5 GPa and the Poisson ratio of ν=0.335. The Young's modulus of duralumin is higher than that of aluminum and lower than that of stainless steel.

Figure 7:
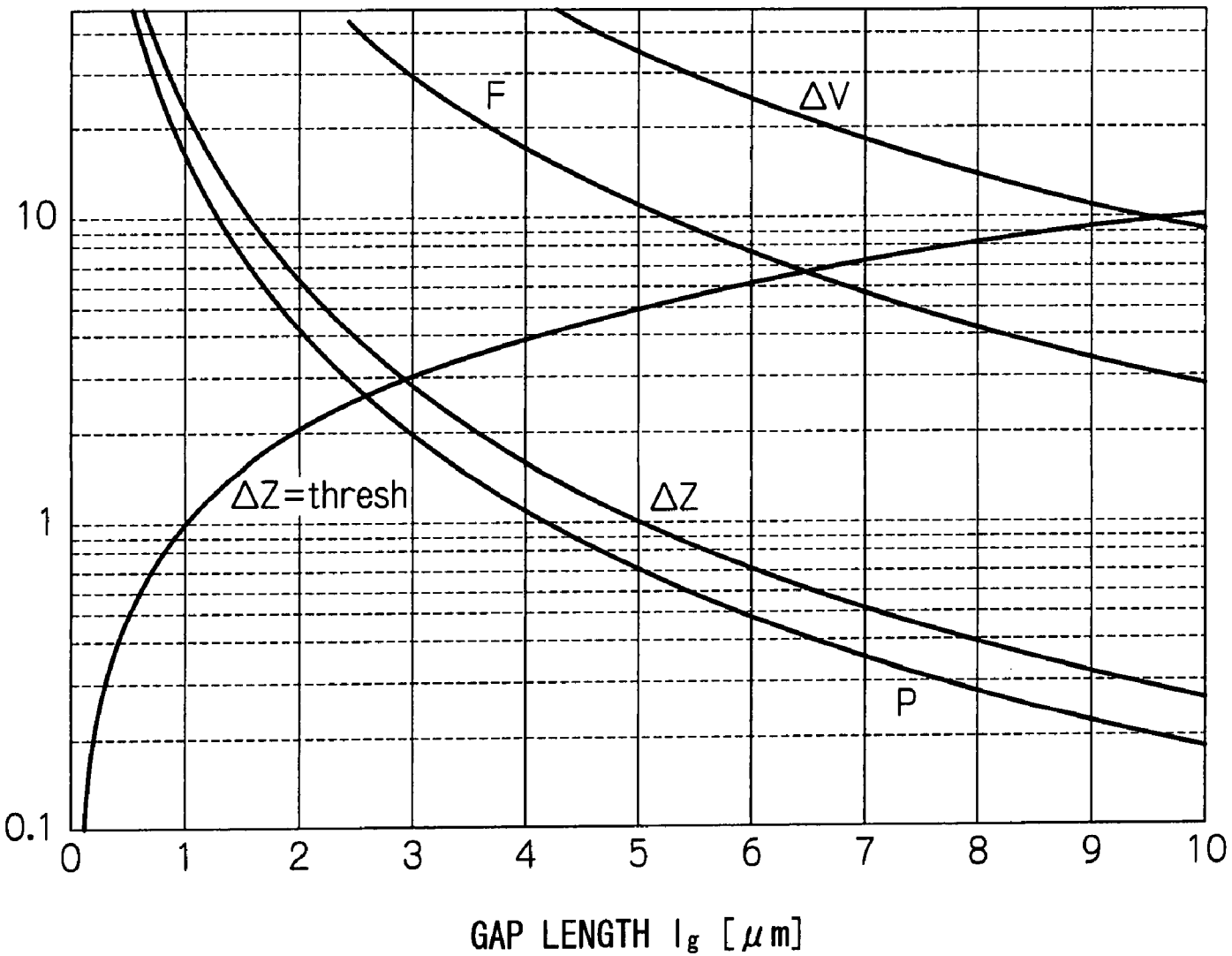

By adopting this composition, the displacement ΔZ, the removed volume ΔV, the generated force F and the generated pressure p corresponding to the gap length $l_g$ between the core 54 and the magnetic body 22 are shown in the graph in FIG. 7. The actual values are found by numerical integration.

ΔZ corresponds to the deflected shape w(r) expressed by Formula (8) when r=0. In other words, ΔZ=w(r=0).

The other parameters are as follows: N=12 turns; I=450 mA; $l_a$=30 μm; $l_n=l_a$; $\mu_0=4\times\pi\times10^{-7}$ Hm; $\mu_a=1000\mu_0$; $\mu_n=\mu_a$; $\mu_g=\mu_0$; $A_a=\pi b^2$ μm$^2$; $A_n=A_a$; and $A_g=A_a$.

As shown in the graph in FIG. 7, when the gap length $l_g$ between the core 54 and the magnetic body 22 is 5 μm, the displacement of ΔZ=1 μm can be expected.

By multiplying the displacement ΔZ of 1 μm by four times to five times through the reflector, a displacement of 4 μm to 5 μm can be obtained. Hence, a mist spray can be achieved even in cases where a high-viscosity ink having a viscosity of approximately 20 cP is used.

Embodiment of Ink Chamber

Figure 8A:
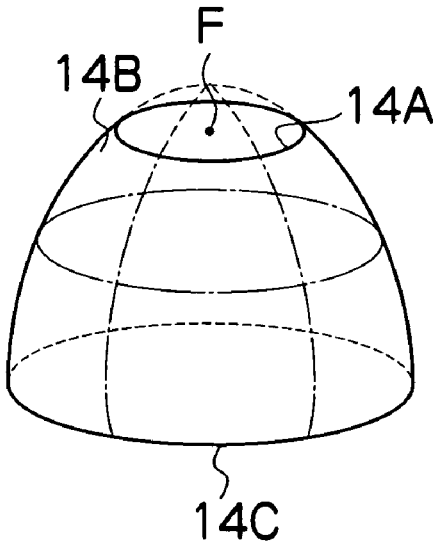
FIGS. 8A and 8B are schematic drawings showing embodiments of the shape of a parabolic surface (reflector) of an ink chamber.
Figure 8B:
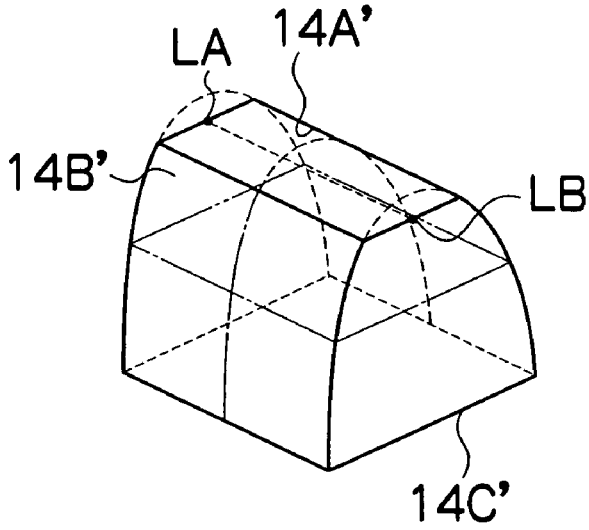

FIGS. 8A and 8B show schematic views of embodiments of the shape of the parabolic surface (reflector) of the ink chamber 14.

The parabolic surface 14B shown in FIG. 8A is the same as the parabolic surface 14B described above with reference to FIG. 3. The parabolic surface 14B has the upstream side opening 14C (the edge of the opening that is in contact with the diaphragm 20) and the downstream side opening 14A (the edge of the opening that is in contact with the nozzle forming plate 24), both openings being substantially circular. The parabolic surface 14B has the focus F on the center of the circular opening 14A.

The parabolic surface 14B' shown in FIG. 8B differs from the parabolic surface 14B shown in FIG. 8A in that the upstream side opening 14C' has a square shape, and the downstream side opening 14A' has a slit shape. The parabolic surface 14B' has focuses forming the line LA-LB, which is the center line of the slit shape opening 14A'.

In comparison between the parabolic surface 14B in FIG. 8A and the parabolic surface 14B' in FIG. 8B, the parabolic surface 14B in FIG. 8A is superior in terms of focusing the ultrasonic wave efficiently at the nozzle, whereas the parabolic surface 14B' in FIG. 8B is generally easier to manufacture.

General Composition of Image Forming Apparatus

An embodiment of an image recording apparatus using the mist spraying apparatus 10 described above is explained.

Figure 9:
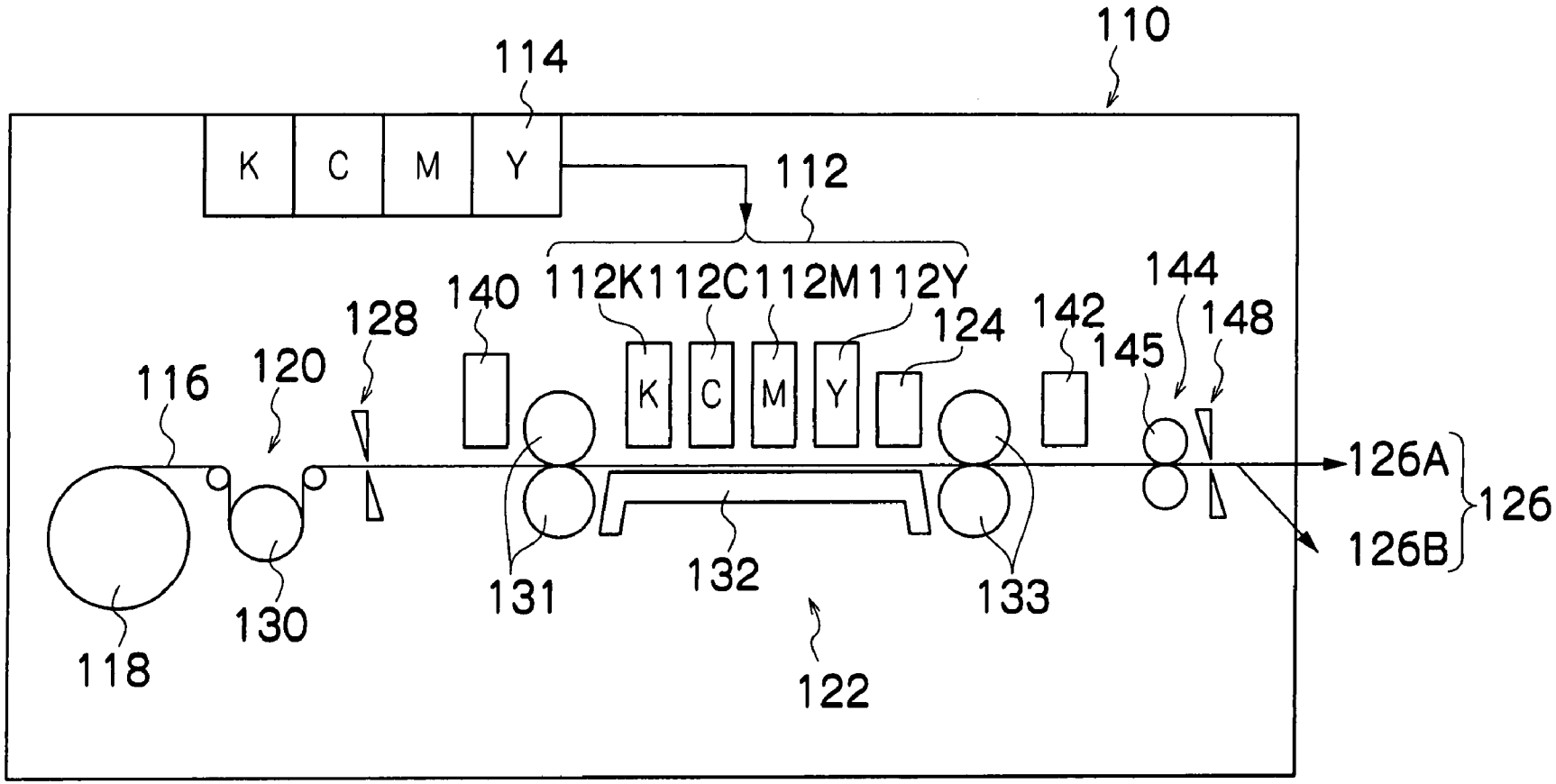
FIG. 9 is an overall compositional diagram showing an image forming apparatus according to an embodiment of the present invention.

FIG. 9 is a general configuration diagram of an image forming apparatus of an embodiment according to the present invention. As shown in FIG. 9, the image forming apparatus 110 comprises: a printing unit 112 having a plurality of mist spraying heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the print heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink spraying face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels.

In FIG. 9, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine.

In the case of the configuration in which roll paper is used, a cutter (first cutter) 128 is provided as shown in FIG. 9, and the continuous paper is cut into a desired size by the cutter 128. When cut papers are used, the cutter 128 is not required.

After decurling, the cut recording paper 116 is nipped and conveyed by the pair of conveyance rollers 131, and is supplied onto a platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the opposite electrode. The platen 132 in FIG. 9 has a width dimension which is greater than the width of the recording paper 116, and at least the portion of the platen 132 opposing the nozzle surface of the print unit 112 and the sensor surface of the print determination unit 124 is a horizontal surface (flat surface).

A heating fan 140 is disposed on the upstream side of the printing unit 112 in the conveyance pathway of the recording paper 116. The heating fan 140 blows heated air onto the recording paper 116 to heat the recording paper 116 immediately before printing so that the ink deposited on the recording paper 116 dries more easily.

Figure 10:
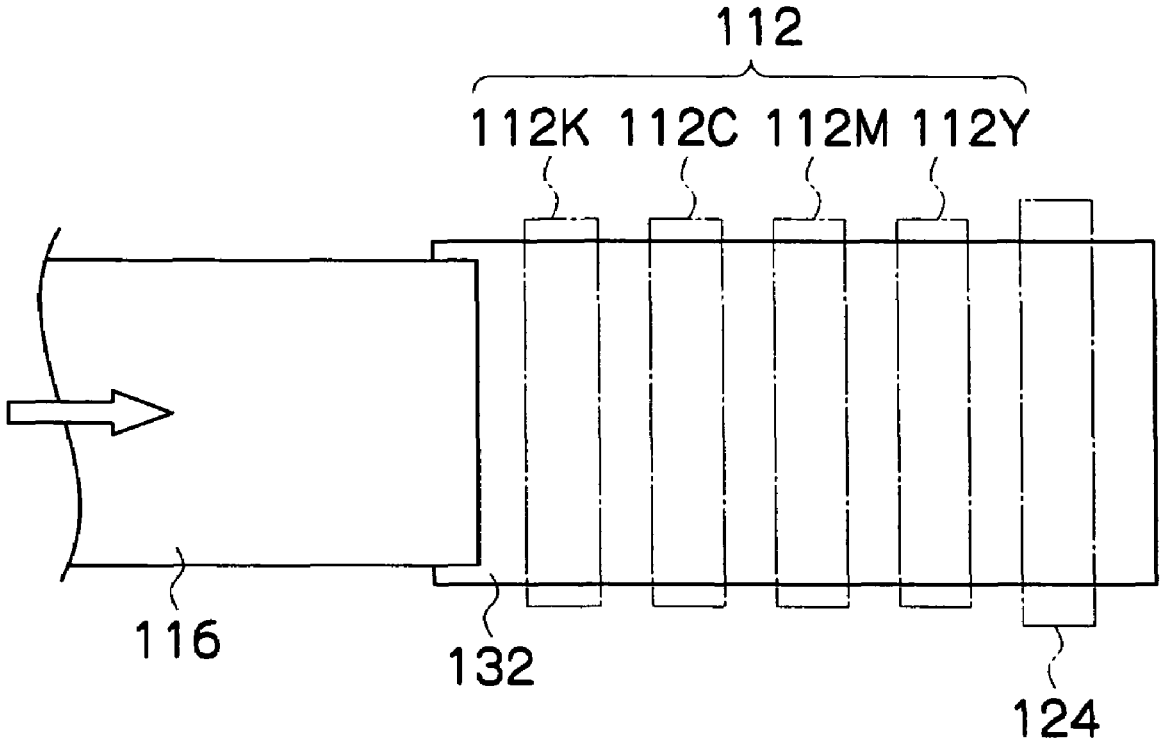
FIG. 10 is a plan view of the principal part of the peripheral area of a print unit in the image forming apparatus illustrated in FIG. 9.

The heads 112K, 112C, 112M and 112Y of the printing unit 112 are full line heads having a length corresponding to the maximum width of the recording paper 116 used with the image forming apparatus 110, and comprising a plurality of nozzles for spraying ink arranged on a nozzle face through a length exceeding at least one edge of the maximum-size recording paper (namely, the full width of the printable range) (see FIG. 10).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by spraying inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which heads for spraying light-colored inks such as light cyan and light magenta are added. Furthermore, there are no particular restrictions of the sequence in which the heads of respective colors are arranged.

The print determination unit 124 illustrated in FIG. 9 has an image sensor (line sensor or area sensor) for capturing an image of the droplet ejection result of the print unit 112, and functions as a device to check for spraying defects such as blockages, landing position displacement, and the like, of the nozzles from the image of ejected droplets read in by the image sensor. A test pattern or the target image printed by the print heads 112K, 112C, 112M, and 112Y of the respective colors is read in by the print determination unit 124, and the print result is determined.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the image forming apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 9, the paper output unit 126A for the target prints is provided with a sorter for collecting prints according to print orders.

General Structure of Head

Next, the general structure of the head is described. The heads 112K, 112C, 112M and 112Y of the respective ink colors have the same structure, and a reference numeral 150 is hereinafter designated to any of the heads.

Figure 11:
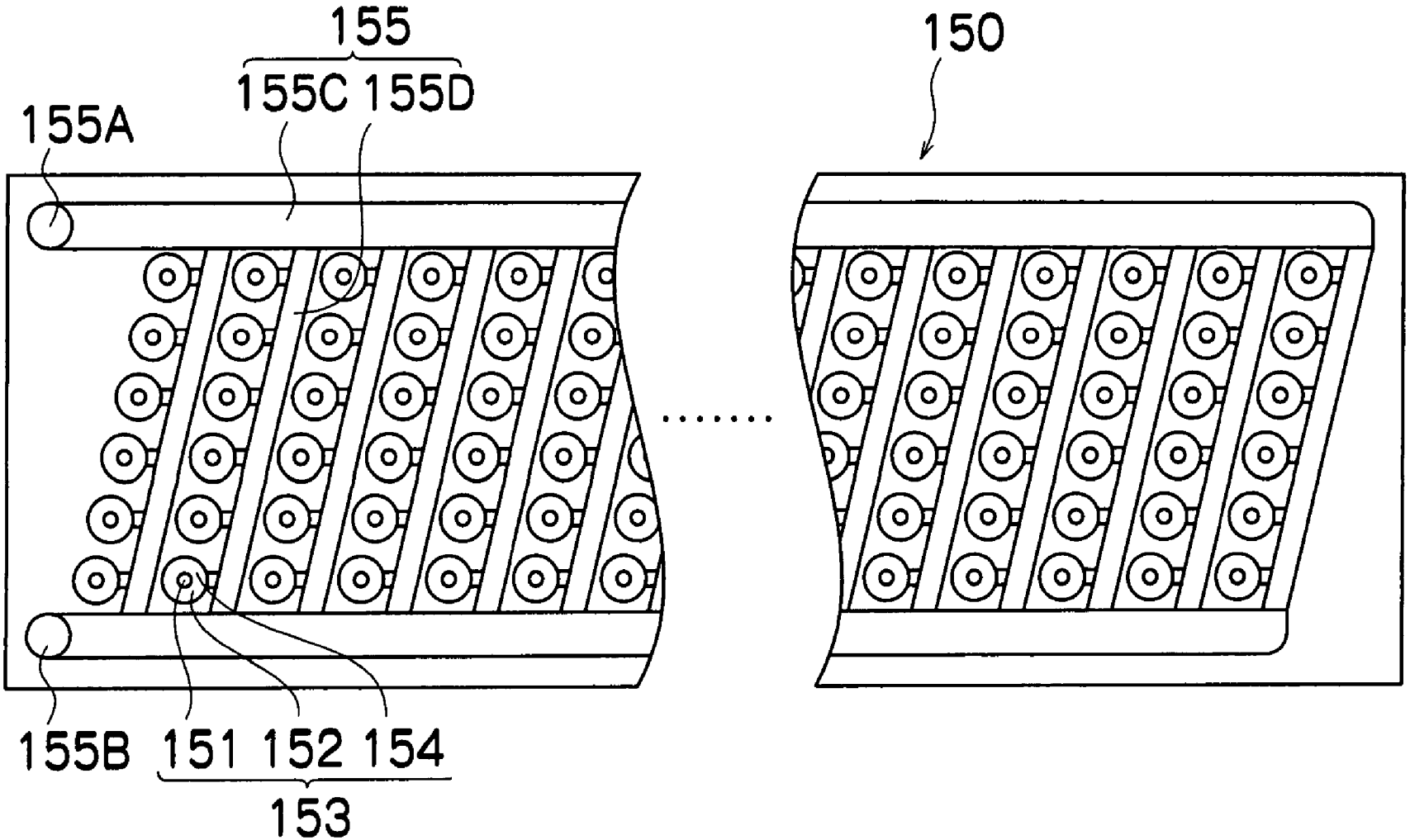
FIG. 11 is a plan view perspective diagram showing an embodiment of a head.

FIG. 11 is a plan view perspective diagram of the head 150. The nozzle pitch in the print head 150 should be minimized in order to maximize the resolution of the dots printed on the surface of the recording paper 116. As shown in FIG. 11, the head 150 according to the present embodiment has a structure in which a plurality of ink chamber units (liquid spraying elements) 153, each having a nozzle 151 forming an ink spraying port, an ink chamber 152 corresponding to the nozzle 151, and the like, are disposed in the form of a two-dimensional matrix, and hence the effective nozzle interval (the projected nozzle pitch) as projected in the lengthwise direction of the head (the direction perpendicular to the paper conveyance direction) is reduced (high nozzle density is achieved). In FIG. 11, in order to simplify the drawing, a portion of the ink chamber units 153 is omitted from the drawing.

The ink chambers 152 are connected to a common flow channel 155 through individual supply paths 154. The common flow channel 155 is connected to an ink tank which forms an ink source (not shown in FIG. 11 and equivalent to the ink storing and loading unit 114 shown in FIG. 9), through connection ports 155A and 155B, and the ink supplied from the ink tank is distributed and supplied to the ink chambers 152 of the respective channels through the common flow channel 155 in FIG. 11. The reference numeral 155C in FIG. 11 indicates a main channel of the common flow channel 155 and 155D indicates a distributary channel which branches off from the main channel 155C.

To give a brief description of the correspondence of the head 150 shown in FIG. 11 to the composition shown in FIGS. 1 to 3, the nozzles 151, the ink chambers 152 and the individual supply paths 154 in FIG. 11 correspond respectively to the nozzles 12, the ink chambers 14 and the ink supply ports 16 shown in FIGS. 1 to 3. Furthermore, in FIG. 11, the distributary channels 1 55D of the common flow channel 155 correspond to the common flow channel 18 shown in FIG. 1.

The detailed structure of the respective ink chamber units 153 in FIG. 11 is similar to that described in FIGS. 1 to 3.

Figure 12:
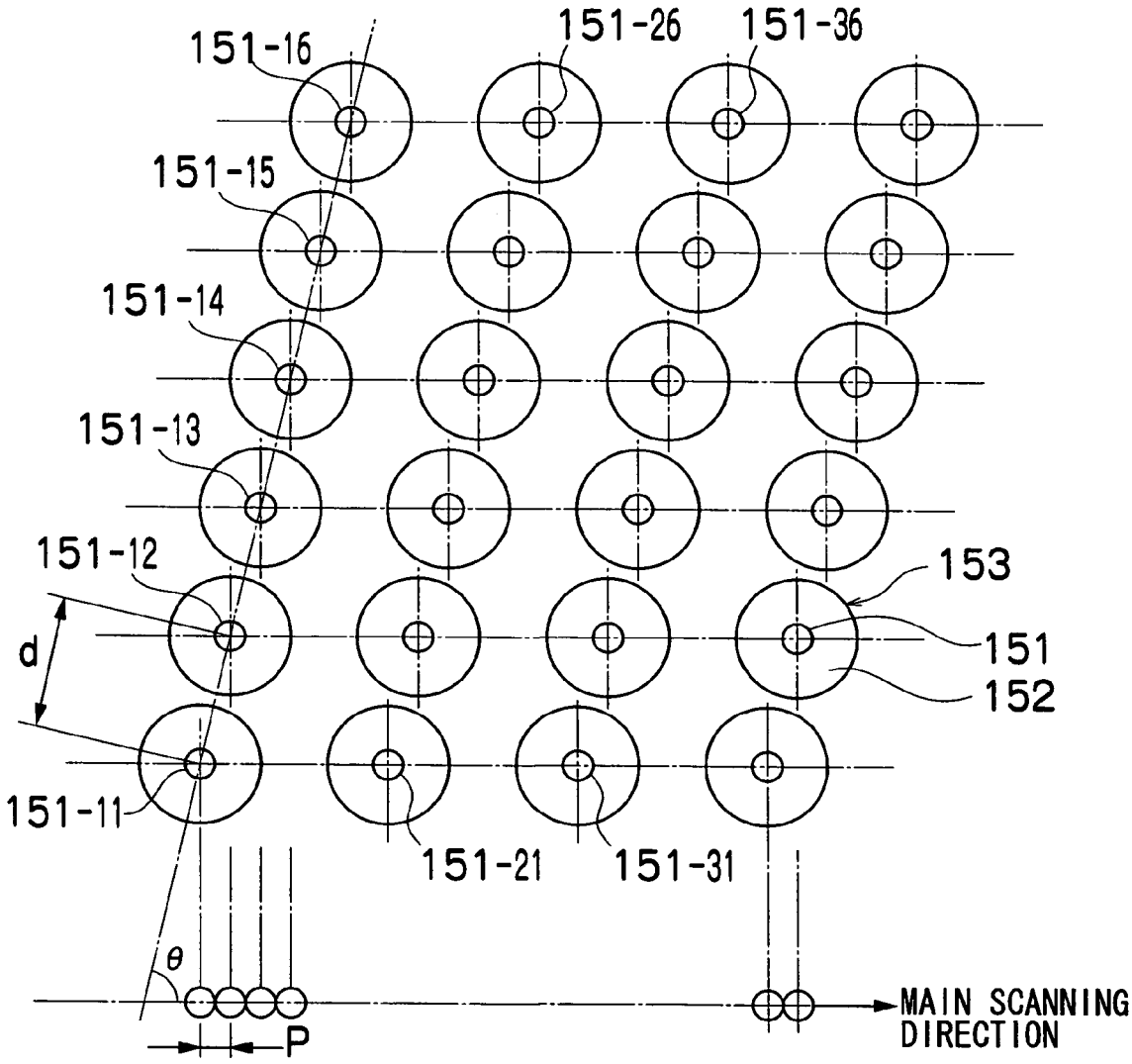
FIG. 12 is an enlarged view showing an enlarged view of a portion of the head shown in FIG. 11.

FIG. 12 is an enlarged view showing an enlarged view of a portion of the print head 150 shown in FIG. 11. As shown in FIG. 12, the plurality of ink chamber units 153 are arranged in a lattice configuration in two directions: the main scanning direction and an oblique direction forming a prescribed angle of θ with respect to the main scanning direction. In other words, the plurality of nozzles 151 are arranged in a two-dimensional matrix configuration. By arranging the nozzles in a two-dimensional matrix of this kind, a high density is achieved for the effective nozzle density.

More specifically, by arranging the plurality of ink chamber units 153 at a uniform pitch of d in an oblique direction forming the uniform angle of θ with respect to the main scanning direction, it is possible to treat the nozzles 151 as being equivalent to an arrangement of nozzles at a pitch P (=d×cos θ) in a straight line in the main scanning direction. Consequently, it is possible to achieve a composition which is substantially equivalent to a high-density nozzle arrangement of 2400 nozzles per inch in the main scanning direction.

Figure 13:
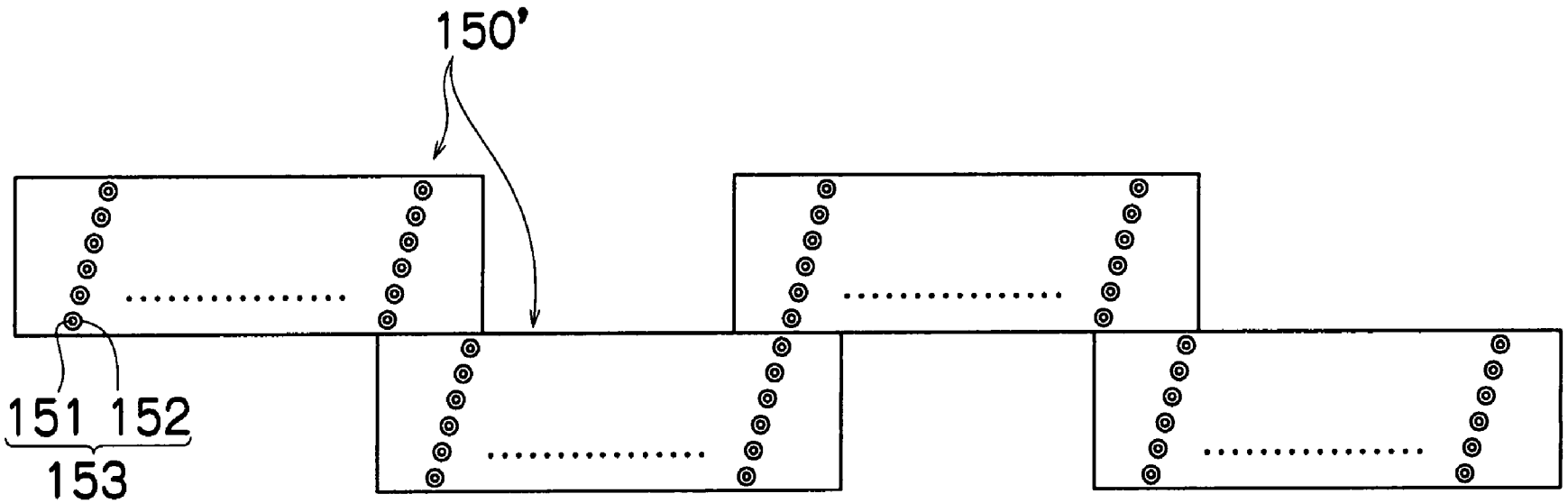
FIG. 13 is a plan view perspective diagram showing a further embodiment of a full line head.

In implementing the present invention, the nozzle arrangement structure is not limited to the embodiment shown in FIGS. 11 and 12. For example, in one mode of a full line head which has a nozzle row extending through a length corresponding to the full width of the recording paper 116 in a direction substantially perpendicular to the conveyance direction of the recording paper 116, instead of the composition shown in FIG. 11, it is possible to compose a line head having a nozzle row of a length corresponding to the full width of the recording paper 116 by joining together, in a staggered matrix arrangement, a plurality of short head blocks 150', each comprising a plurality of nozzles 151 arranged in a two-dimensional configuration, as shown in FIG. 13, for instance.

Description of Control System

Figure 14:
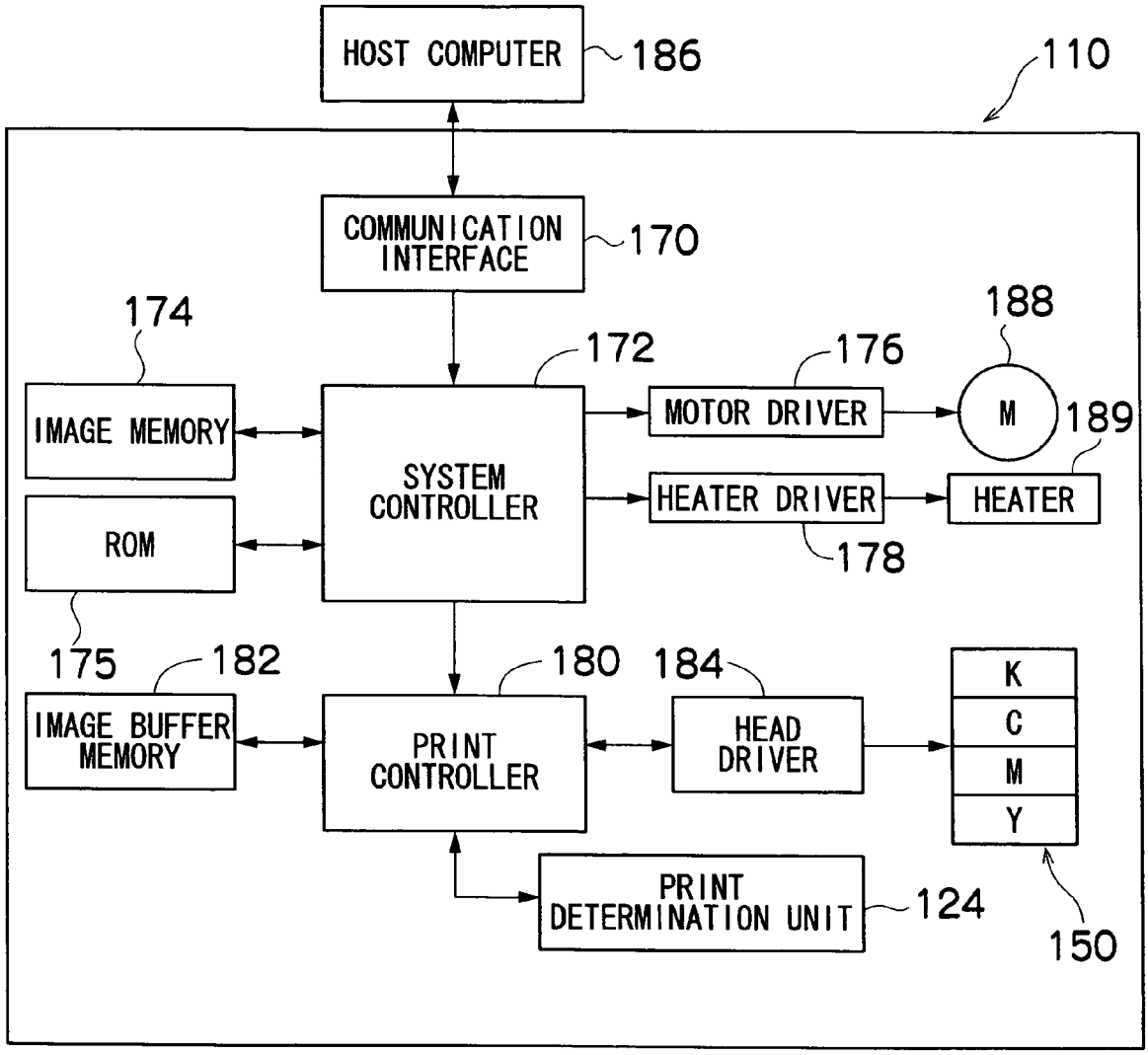
FIG. 14 is a principal block diagram showing the system composition of the image forming apparatus.

FIG. 14 is a block diagram showing the system configuration embodiment of the image forming apparatus 110. As shown in FIG. 14, the image forming apparatus 110 comprises a communication interface 170, a system controller 172, an image memory 174, a ROM 175, a motor driver 176, a heater driver 178, a print controller 180, an image buffer memory 182, a head driver 184, and the like.

The communication interface 170 is an image input device for receiving image data sent from a host computer 186. A wired interface such as USB, IEEE1394, Ethemet, or wireless network may be used as the communication interface 170.

The image data sent from the host computer 186 is received by the image forming apparatus 110 through the communication interface 170, and is temporarily stored in the image memory 174.

The system controller 172 is constituted by a central processing unit (CPU) and peripheral circuits thereof, and the like, which controls the whole of the image forming apparatus 110 in accordance with a prescribed program. More specifically, the system controller 172 controls the various sections, such as the communication interface 170, image memory 174, motor driver 176, heater driver 178, and the like, and as well as controlling communications with the host computer 186 and writing and reading to and from the image memory 174 and ROM 175, it also generates control signals for controlling the motor 188 and heater 189 of the conveyance system. The motor 188 of the conveyance system is a motor which applies a drive force to the drive rollers of the pairs of conveyance rollers 131 and 133 shown in FIG. 9, for example. Furthermore, the heater 189 is a heating device which is used in the heating drum 130, heating fan 140 or post drying unit 142, as shown in FIG. 9..

The program executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 in accordance with commands from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate a signal for controlling ink spraying, from the image data in the image memory 174, and it supplies the data (dot data) thus generated to the head driver 184.

The print controller 180 is provided with the image buffer memory 182; and image data, parameters, and other data are temporarily stored in the image buffer memory 182 when image is processed in the print controller 180. The aspect shown in FIG. 14 is one in which the image buffer memory 182 accompanies the print controller 180; however, the image memory 174 may also serve as the image buffer memory 182. Also possible is an aspect in which the print controller 180 and the system controller 172 are integrated to form a single processor.

To give a general description of the sequence of processing from image input to image formation, image data to be formed is input from an external source through the communication interface 170, and is accumulated in the image memory 174. At this stage, RGB image data is stored in the image memory 174, for example.

In this image forming apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y In this way, the dot data generated by the print controller 180 is stored in the image buffer memory 182.

The head driver 184 outputs drive signals for driving the electromagnets 56 corresponding to the respective nozzles 151 of the print head 150, on the basis of the dot data supplied by the print controller 180 (in other words, the dot data stored in the image buffer memory 182). In other words, the head driver 184 corresponds to the "drive unit" of the present invention. A feedback control system for maintain uniform driving conditions in the head may also be incorporated into the head driver 184.

By supplying the drive signals outputted by the head driver 184 to the head 150, an ink mist is sprayed from the corresponding nozzles 151. By controlling ink spraying from the head 150 in synchronization with the conveyance speed of the recording paper 116, an image is formed on the recording paper 116.

As a concrete mode of the magnetic actuator which causes the diaphragm to vibrate by means of a magnetic force, the embodiment is described in which the core 54 (first magnetic body) is disposed inside the coil 52, the attracted member 22 (second magnetic body) is provided on the diaphragm 20 at the separated position from the core 54, and the diaphragm 20 is caused to vibrate by means of the core 54 becoming magnetized when a current flows in the coil 52, thereby generating a magnetic force between the core 54 and the attracted member 22. However, it is also possible to use a magnetic actuator having a different composition to this.

For example, it is also possible to use a magnetic actuator having a composition in which the diaphragm itself is formed by a magnetic body, the magnetic body is disposed on the inner side of the coil, and the magnetic body inside the coil becomes magnetized when an electric signal of an ultrasonic frequency is applied to the coil, thereby generating a magnetic force between the magnetic body and the diaphragm (magnetic body), which causes the diaphragm to vibrate ultrasonically.

Furthermore, for example, it is also possible to use a dynamic type of magnetic actuator which is composed in such a manner that a recess section is provided in the diaphragm, a coil is wound in the recess section (in other words, the coil is wound inside the diaphragm as such), and the diaphragm is made to vibrate ultrasonically by applying an electric signal of an ultrasonic frequency to the coil.

Furthermore, the shape of the parabolic surface (reflector) 14B of the ink chamber 14 is not limited to that illustrated, and the shape may also be improved, appropriately.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist spraying apparatus, comprising:

a liquid chamber into which liquid is filled;

a coil which is applied with an electrical signal to generate a magnetic filed, the electrical signal having a frequency corresponding to an ultrasonic wave;

a diaphragm which is vibrated by the magnetic field generated by the coil, and imparts the ultrasonic wave to the liquid in the liquid chamber;

a spraying port which is connected to the liquid chamber and sprays the liquid converted into a mist by the ultrasonic wave;

a drive unit which applies the electrical signal to the coil;

a first magnetic body which is disposed inside the coil; and a second magnetic body which is arranged on the diaphragm in a separated position from the first magnetic body, wherein the diaphragm vibrates due to a magnetic force between the first magnetic body and the second magnetic body, when the first magnetic body is magnetized by flow of current of the electrical signal in the coil.

2. An image forming apparatus, comprising the mist spraying apparatus as defined in claim 1, which forms an image on a prescribed liquid receiving medium by means of the liquid sprayed from the spraying port.

3. The mist spraying apparatus as defined in claim 1, wherein the second magnetic body is bonded to a surface of the diaphragm reverse to a surface of the diaphragm adjacent to the ink chamber.

4. A mist spraying apparatus, comprising:

a liquid chamber into which liquid is filled;

a coil which is applied with an electrical signal to generate a magnetic filed, the electrical signal having a frequency corresponding to an ultrasonic wave;

a diaphragm which is vibrated by the magnetic field generated by the coil, and imparts the ultrasonic wave to the liquid in the liquid chamber;

a spraying port which is connected to the liquid chamber and sprays the liquid converted into a mist by the ultrasonic wave; and a drive unit which applies the electrical signal to the coil, wherein the liquid chamber has a parabolic inner surface shape which reflects the ultrasonic wave applied to the liquid in the liquid chamber by the diaphragm, and focuses the ultrasonic wave at the spraying port.

5. An image forming apparatus, comprising the mist spraying apparatus as defined in claim 4, which forms an image on a prescribed liquid receiving medium by means of the liquid sprayed from the spraying port.

6. The mist spraying apparatus as defined in claim 4, wherein the parabolic inner surface shape of the ink chamber is rotationally symmetrical with respect to an axis perpendicular to the diaphragm.

7. The mist spraying apparatus as defined in claim 6, wherein both an upstream opening and a downstream opening of the ink chamber are substantially circular.

8. The mist spraying apparatus as defined in claim 4, wherein the parabolic inner surface shape of the ink chamber is parabolic with respect to a first direction lateral to an axis perpendicular to the diaphragm.

9. The mist spraying apparatus as defined in claim 8, wherein both an upstream opening and a downstream opening of the ink chamber are substantially rectangular.

10. The mist spraying apparatus as defined in claim 9, wherein the upstream opening of the ink chamber is substantially square.

11. A mist spraying apparatus, comprising:

a liquid chamber into which liquid is filled;

a coil which is applied with an electrical signal to generate a magnetic filed, the electrical signal having a frequency corresponding to an ultrasonic wave;

a diaphragm which is vibrated by the magnetic field generated by the coil, and imparts the ultrasonic wave to the liquid in the liquid chamber;

a spraying port which is connected to the liquid chamber and sprays the liquid converted into a mist by the ultrasonic wave; and a drive unit which applies the electrical signal to the coil, wherein the diaphragm is made of duralumin.

12. An image forming apparatus, comprising the mist spraying apparatus as defined in claim 11, which forms an image on a prescribed liquid receiving medium by means of the liquid sprayed from the spraying port.

* * * * *